United States Patent [19]

Brandt

[11] Patent Number: 4,840,136

[45] **Date of Patent: * Jun. 20, 1989**

[54] PROPELLER DRIVE FOR BOATS

[75] Inventor: Lennart H. Brandt, Fjärås, Sweden

[73] Assignee: AB Volvo Penta, Gothenburg, Sweden

[ * ] Notice: The portion of the term of this patent subsequent to Oct. 6, 2004 has been disclaimed.

[21] Appl. No.: 95,112

[22] Filed: Sep. 11, 1987

Related U.S. Application Data

[63] Continuation of Ser. No. 778,310, Sep. 20, 1985, Pat. No. 4,698,036, which is a continuation of Ser. No. 531,613, Sep. 12, 1983, abandoned.

[30] Foreign Application Priority Data

Sep. 13, 1982 [SE] Sweden ..... 8205215

[51] Int. Cl.[4] ..... B63H 21/24

[52] U.S. Cl. ..... 440/78; 440/81

[58] Field of Search ..... 440/54–89

[56] References Cited

U.S. PATENT DOCUMENTS

| | | | |
|---|---|---|---|
| 2,987,031 | 6/1961 | Odden | 440/81 |
| 3,404,656 | 10/1968 | Chamberlan | 440/62 |
| 3,765,370 | 10/1973 | Shimanckas | 440/58 |
| 3,769,930 | 11/1973 | Pinkerton | 440/58 |
| 4,052,952 | 10/1977 | Hale et al. | 440/81 |
| 4,297,097 | 10/1981 | Kiekhaefer | 440/59 |

*Primary Examiner*—Joseph F. Peters, Jr.
*Assistant Examiner*—Jesûs D. Sotelo

[57] ABSTRACT

A double-propeller drive unit for boats, in which the under-water housing of the drive unit is designed so that the pressure center for the transverse force on the drive housing caused by water flow is located in front of the steering axis of the drive unit.

4 Claims, 2 Drawing Sheets

Figure 1:
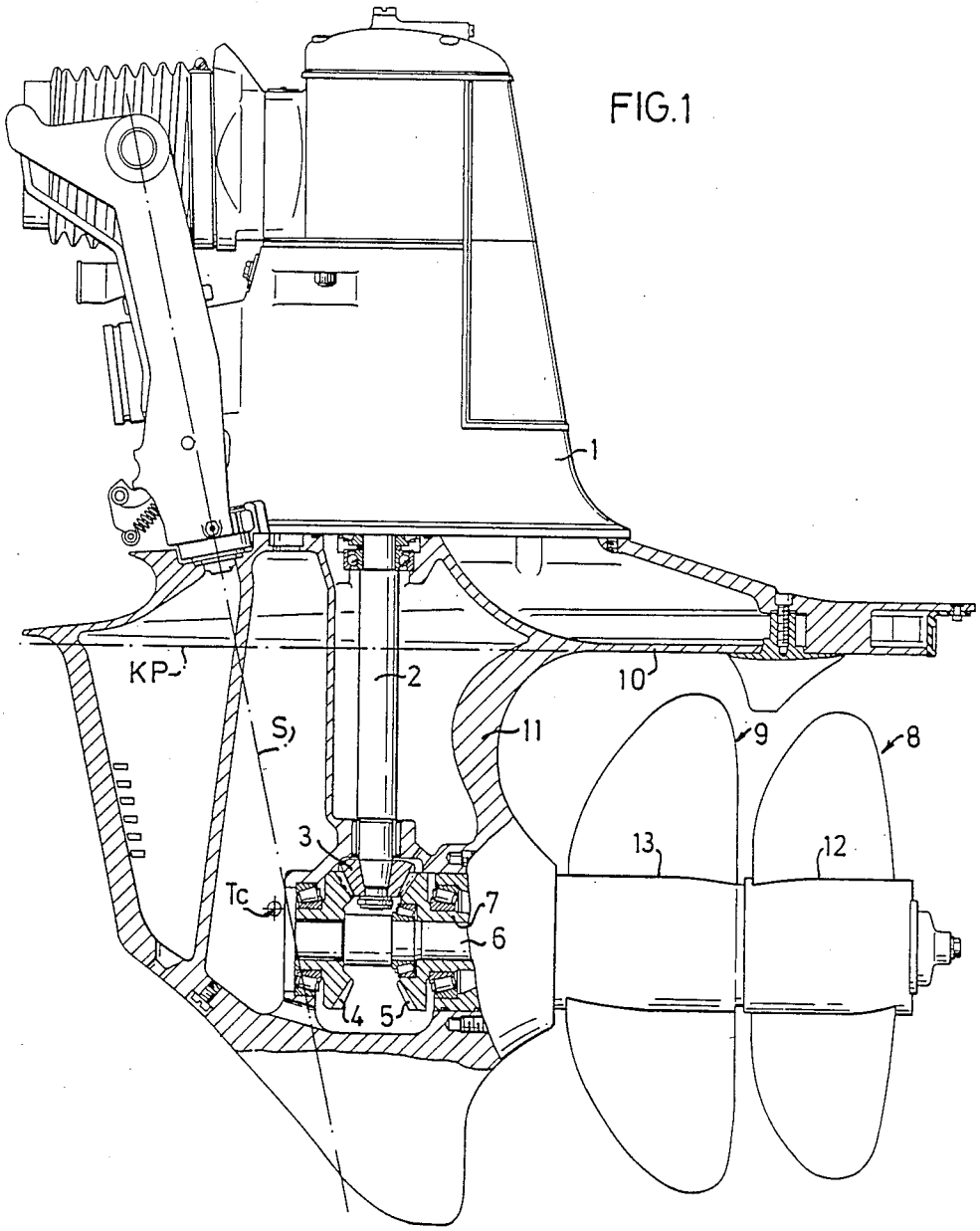

1
2
3
4
5
6
7
8
9
10
11
12
13
KP
S
Tc

PROPELLER DRIVE FOR BOATS

This is a continuation of co-pending application Ser. No. 778,310, filed on Sept. 20, 1985, now U.S. Pat. No. 4,698,036, which was a continuation of Ser. No. 531,613, filed on Sept. 12, 1983, now abandoned.

The present invention relates to a propeller drive for boats, comprising a pair of concentric counter-rotationally driven propeller shafts in a drive housing, each of said shafts carrying at least one propeller, said drive housing being pivotable about a steering axis and having an anticavitation plate located above the propeller.

When driving a planing boat equipped with an inboard engine and an outboard drive unit, a so-called inboardoutboard, the driver experiences certain steering wheel forces both when driving straight ahead and when turning. The steering wheel forces when turning are a result of the oblique flow of the water which produces two types of transverse forces, namely, on the one hand, a transverse force (lift) on the underwater housing of the drive unit, and on the other hand a transverse force on the propeller, when there is oblique flow, caused by the increased lift of the propeller blades meeting the flow and decreased lift of the blades moving with the flow.

Generally, these forces are dependent on speed and power. The transverse forces acting on a conventional single propeller drive unit when turning are, however, normally low even at high engine power, because for practical reasons these drive units are provided with propellers which operate somewhat overloaded, so that the blades cavitate somewhat, especially in turning when the flow angle against the blade beings to pulsate when sweeping around when driving at relatively low speed. By virtue of the fact that the transverse force on the propeller is low even during sharp manoeuvres and because the center of pressure of the underwater housing in single propeller drive units is normally located behind the steering axis but relatively close thereto, negligible steering forces are usually obtained.

In double propeller drive units, for example of the type described in U.S. patent application Ser. No. 354,769, now abandoned, and continuation application Ser. No. 576,150, now U.S. Pat. No. 4,619,584, issued Oct. 28, 1986, the propellers of which are optimally designed with respect to top speed, fuel consumption and acceleration, the conditions are different. Here, the blade surface is selected so that the pressure force is divided equally between the two propellers which operate without cavitation even when making very sharp turns. The critical point for propeller slippage is moved in principle outside the rudder angle range in question. The propeller transverse force is thus a factor which must be considered in double propeller drive units, especially since this force has a long moment arm in relation to the axis of turning rotation of the drive unit. At high engine power, the steering torque exerted on the propellers due to the transverse force can be so great that the drive unit can not be manoeuvred without difficulty with conventional cable steering. Hydraulic steering is then required.

The purpose of the present invention is to achieve a propeller drive unit of the type described by way of introduction, which makes it possible to reduce the effect of the transverse forces on the steering torque exerted on the drive unit, so that both the shock loads during sharp turning manoeuvres and the steering forces during normal manoeuvres can be reduced to a level which permits the use of conventional cable steering even at high engine power.

This is achieved according to the invention by virtue of the fact that the projected surface of the portion of the drive housing located beneath the anticavitation plate and in front of the steering axis is at least half but at most twice as large as the sum of the projected surface of the portion of the drive housing located below the anticavitation plate and behind the steering axis and the projection surface of the hubs of the propeller.

Oblique water flow subjects a symmetrical drive housing with arched sides to a transverse force, the pressure center of which lies on the steering axis when the surface in front of the steering axis amounts to approximately 33% of the surface behind the steering axis. Normally, a non-hydraulically steered single propeller drive has a surface in front of the steering axis amounting to between 10 and 20% of the surface behind the steering axis, so that the pressure center for the flow force will be behind the steering axis. By instead, in accordance with the invention, designing the drive unit so that the surface in front of the steering axis is at least 50% of the surface behind the steering axis, the pressure center of the flow force is moved forward to a position in front of the steering axis. The steering torque exerted by the flow force on the drive unit will thus balance the torque exerted by the propeller transverse force, thus providing a lower resultant steering torque.

Complete balancing at all speeds is impossible to achieve, since the flow force is dependent on speed. The surface distribution and thus the position of the pressure center in front of the steering axis is therefore selected so that the turning moments exerted by the flow force and the propeller transverse force are approximately equal in the upper end of the speed range which the drive unit is designed for. This is to avoid over-steering in the upper speed range. The lower the boat speed range is for which the drive unit is designed, the larger the surface in front of the steering axis must be in relation to the surface behind the steering axis, because a lower drive unit speed results in a lower flow force, increasing the domination of the propeller transverse force. In practice one can assume that the flow force is never lower than the propeller transverse force, which means that the surface in front of the steering axis may at most be twice as great as the surface behind the steering axis. As above, the surface behind the steering axis includes both the surface of the drive housing itself under the cavitation plate (the so-called wet surface) and the surface of the propeller hubs.

The invention will be described in more detail with reference to an example shown in the accompanying drawings.

Figure 2:
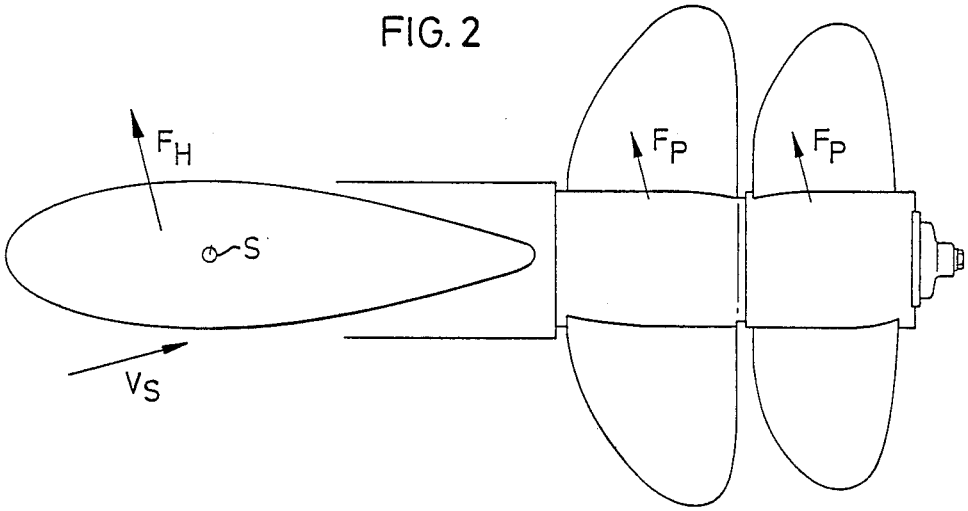

FIG. 1 shows a side-view in partial section of a double propeller drive unit according to the invention, and FIG. 2 shows a schematic cross-sectional profile of the underwater housing of the drive unit.

The propeller drive unit shown in FIG. 1 is a so-called inboard-outboard drive unit, designed to be mounted on a boat transom and be connected to the output shaft of an engine (not shown). The driven unit comprises a housing 1 and contains a reversing mechanism with an output shaft 2, which has a conical gear 3 in constant engagement with two conical gears 4 and 5. The gear 4 drives a propeller shaft 6 and the gear 5 drives a hollow propeller shaft 7 mounted concentrically with the shaft 6. The shaft 6 carries a propeller 8 and the shaft 7 carries a propeller 9. The arrangement described results in the propeller shafts rotating in opposite directions, the rotational direction of the shaft 2 being selected so that the shaft 7 rotates counterclockwise as seen from the rear.

The drive housing 1 can pivot about an inclined axis S, which, as is conventional, intersects the drive joint (not shown) between the engine and the drive unit. The mounting and steering mechanism of the drive are known per se and are not described in more detail here. The angle between the pivot axis S and the drive shaft 2 is in the example shown here 12°.

The drive housing is made with an anticavitation plate 10 which extends aft over the propellers. The portion of the drive housing 1 situated beneath the plane KP of the anticavitation plate is the underwater housing 11 of the drive unit. The projective surface of the portion of the underwater housing beneath the plane KP and in front of the steering axis S, in the embodiment shown in the drawing, amounts to 55% of the surface of the housing beneath the plane KP and behind the steering axis S including the projective surface of the hubs 12, 13 of the propellers 8,9. The pressure center Tc of the flow force will then be slightly in front of the steering axis S. This drive unit is primarily intended for diesel engines rated 150–300 HP and for speeds of over 25 knots.

The forces $F_H$ and $F_P$ acting on the drive housing and the propellers respectively during a turning manoeuvre exert in this case oppositely directed torques on the drive unit, as can be seen in FIG. 2, in which the arrow Vs indicates the direction of flow of the water. In the embodiment shown in FIG. 1, with the surface relation of 55%, the shock loads during sharp manoeuvres are reduced by more than half and the steering forces in normal manoeuvres are reduced by about 30% over those in an unbalanced double propeller drive unit.

In the preceding, the invention has been described with reference to an inboard-outboard drive unit designed to be mounted on a transome, but it can of course also be applied to drive units in which the drive housing is designed to be mounted extending through an opening in the bottom of the boat, a so-called S-drive.

What I claim is:

1. In a propeller drive unit for boats having steering means to steer same and a pair of concentric counter-rotationally drive propeller shafts in a drive housing, each of said shafts carrying at least one propeller having a hub, said drive housing having a substantially vertical output drive shaft extending generally the length of said housing and having its lower end coupled to said pair of shafts, and a steering axis for steering said drive housing thereabout, and an anti-cavitation plate located above said propellers, the improvement wherein said drive housing comprises a forward projected surface located beneath a first plane generally horizontally defined by said anti-cavitation plate and forwardly of a second plane passing generally laterally through said first plane and through and along said steering axis, said forward projected surface being at least half but at most twice as large as a rearward projected surface of a portion of said drive housing located beneath said first plane and behind said second plane and a rearward projected surface of said hubs of said propellers thereby reducing the resultant steering torque exerted by the water flow force on said drive unit counteracting against transverse forces of said propellers whereby steering forces to be applied to said steering means is reduced.

2. In the propeller drive unit according to claim 1 wherein said forward projected surface is 55% of said rearward projected surfaces.

3. In the propeller drive unit according to claim 1 wherein said steering axis is inclined with respect to said drive shaft.

4. In the propeller drive unit according to claim 3 wherein said steering axis and drive shaft form an included angle which is a small acute angle.

* * * * *